US007096522B2

(12) United States Patent
Hirtriter

(10) Patent No.: US 7,096,522 B2
(45) Date of Patent: Aug. 29, 2006

(54) BATH OVERFLOW ALARM SUITABLE FOR DIFFERENT INSTALLATION ARRANGEMENTS

(76) Inventor: R. Eric Hirtriter, 4102 Flamingo Ct., Pearland, TX (US) 77584

( * ) Notice: Subject to any disclaimer, the term of this patent is extended or adjusted under 35 U.S.C. 154(b) by 416 days.

(21) Appl. No.: 10/313,418

(22) Filed: Dec. 6, 2002

(65) Prior Publication Data

US 2004/0107497 A1 Jun. 10, 2004

(51) Int. Cl.
*E03C 1/244* (2006.01)

(52) U.S. Cl. ..... 4/694; 4/668; 4/651; 4/661

(58) Field of Classification Search ..... 4/694, 4/508, 661, 668, 669, 651; 340/618, 612, 340/616

See application file for complete search history.

(56) References Cited

U.S. PATENT DOCUMENTS

| | | | | |
|---|---|---|---|---|
| 2,041,549 | A | 5/1936 | Jaeger | |
| 2,602,846 | A | 7/1952 | Polikoff | |
| 3,889,247 | A | 6/1975 | Voll | |
| 4,042,984 | A | 8/1977 | Butler | |
| 4,080,985 | A | 3/1978 | Eagle | |
| 4,258,444 | A | 3/1981 | Orszullok | |
| 4,265,598 | A | 5/1981 | Brand | |
| 4,563,780 | A | 1/1986 | Pollack | |
| 4,586,532 | A * | 5/1986 | Tsolkas | 4/508 |
| 4,757,305 | A | 7/1988 | Peso | |
| 4,771,272 | A | 9/1988 | Barnes | |
| 5,006,834 | A | 4/1991 | Fountain | |
| 5,053,751 | A | 10/1991 | Gould | |
| 5,247,710 | A | 9/1993 | Carder | |
| 5,661,462 | A | 8/1997 | Shrewsbury-Gee | |
| 5,894,611 | A | 4/1999 | Toro | |
| 6,008,728 | A | 12/1999 | Wesey | |
| 6,147,614 | A | 11/2000 | Parish | |
| 6,160,482 | A | 12/2000 | Hill | |
| 6,369,715 | B1 * | 4/2002 | Bennett et al. | 340/618 |
| 6,480,113 | B1 * | 11/2002 | Esposito | 340/624 |
| 2002/0029632 | A1 * | 3/2002 | Nozawa et al. | |
| 2002/0047784 | A1 | 4/2002 | Dunnett | |
| 2002/0121982 | A1 * | 9/2002 | Ferris et al. | |
| 2003/0034895 | A1 * | 2/2003 | Reich | |

* cited by examiner

*Primary Examiner*—Khoa D. Huynh
(74) *Attorney, Agent, or Firm*—Wong, Cabello, Lutsch, Rutherford & Brucculeri LLP

(57) ABSTRACT

Alarms adaptable to common American bathtub cover plate configurations. Two different embodiments are illustrated. In a first embodiment, the alarm unit is designed to allow use with the three different mounting styles of cover plates used in the United States. The unit housing is preferably formed of plastic or metal with different colors and finishes and includes removable areas to allow use with a single center screw; dual screws or a center pivoting drain lever with dual screws. The various electronics components remain sealed inside the waterproof plastic or metal housing in all instances. In a second embodiment, a waterproof housing attaches to an adapter ring. The adapter ring is configured to cooperate with single center screw and dual screw variations. An alternative adapter ring can be used with European and newer American threaded overflow drains. In the first two embodiments there can be upper and lower sensor(s), preferably a pair of each, to provide initial and critical warnings. The warnings include audible warnings emitted by the alarm unit as well as transmitted signals for detection by remote devices.

20 Claims, 5 Drawing Sheets

BATH OVERFLOW ALARM SUITABLE FOR DIFFERENT INSTALLATION ARRANGEMENTS

BACKGROUND OF INVENTION

1. Field of the Invention

The invention relates to a bathtub overflow alarm and more particularly pertains to alerting a user to water reaching a hazardous or dangerous level within a bathtub or other container.

2. Description of the Related Art

People often do other things while waiting for a bathtub to fill in order not to waste time. Sometimes they get engrossed in a different activity and forget they started the water. Most bathtubs are equipped with drains to prevent the overflow of the water; however, that drain line or the cover over the drain line is often not large enough to allow water to go to the drain at the rate the water is entering the bathtub. Thus damage can be caused by the water overflowing the top of the bathtub. The direct damage to surrounding materials can be great but the water may also provide an environment suitable for dangerous mold and mildew or create a slipping hazard when someone finally comes to turn off the water.

American plumbing for bathtubs are installed with piping going vertically up the end of the bathtub to a height level of the overflow drain hole in the bathtub. A right angle of pipe is added to attach the plumbing to the bathtub. That piece of pipe has one or more threaded holes for attaching a fixed overflow cover plate to it and draw it up against the bathtub. At the bottom edge of the cover plate is a narrow opening for the water to evacuate the bathtub when the water level reaches that height. However, this narrow opening often limits the amount of water which can enter the piping to an amount less than that flowing into the bathtub. Thus it is possible to overflow the entire bathtub, with the overflow cover plate fully under water.

American bathtubs have three designs for the overflow cover plate. Two of them just have different screw hole configurations for mounting the cover plate to the overflow pipes. The other has a trip lever in the center with two screw holes. As noted above, the past and present overflow plumbing designs do not allow enough volume of liquid to escape from the bathtub when the bathtub is being filled with the current overflow cover plates. Furthermore, these cover plates and the evacuation areas on the sides of the cover plates may become blocked with a variety of things as well as just a buildup of hard water deposits.

There have been many attempts to solve overflowing of bathtubs in the past but have all met with problems. The majority of examples of prior art in water level alarms are devices which float in the bathtub or suction to the side. These fail for practical purposes because people do not want the device to remain in the bathtub with them while they are relaxing and so must be removable. This means that it is likely that a person will not go to the trouble of setting the device back in the bathtub each time.

There are many different type of fluid level alarms; however, none are financially feasible for the home or commercial bathtub applications. The current designs are attached to the side of bathtubs with suction cups, so they are easily removed or stolen; attached to the wall above the bathtub and get in the way of the person bathing; uses floats which can be fouled by hard water or other debris or are hard to mount; use a diaphragm switch sensitive to pressure changes, but the rubber can wear out and not react or can leak itself, or the switch itself is buoyant, which could get stuck in the drain.

Two designs address some of the problems but create new problems. U.S. Pat. No. 5,661,462 discloses a bath overflow alarm which replaces the bath drain cover and provides an audible alarm. U.S. patent application Ser. No. US2002/0047784 A1 discloses an alternative design for replacing the bath drain cover which further may provide an alarm output using a low-power radio transmitter. While these designs solve some of the prior art problems, they require specific embodiments for each particular bath drain design. This increases their cost and creates inventory problems for both the manufacturer and the retailer. It would be desirable to provide the benefits these designs provide and reduce the cost and inventory problems they create.

SUMMARY OF INVENTION

Alarms according to the present invention are adaptable to common American bathtub cover plate configurations. Two different embodiments are illustrated. In a first embodiment, the alarm unit is designed to allow use with the three different mounting styles of cover plates used in the United States. The unit housing is preferably formed of plastic or plated metal and includes removable areas to allow use with a single center screw; dual screws or a center pivoting drain lever with dual screws. The various electronics components remain sealed inside the waterproof housing in all instances. The electronics components may include an audible device and one or more buttons accessible on the face of the alarm housing for specific functions.

In a second embodiment, a waterproof housing attaches to an adapter ring. The adapter ring is configured to cooperate with single center screw and dual screw variations. An alternative adapter ring is configured with threads for the use with European and newer American threaded overflow drains.

In each embodiment there are upper and lower sensors, preferably a pair of each, to provide initial and critical warnings. The warnings include audible warnings emitted by the alarm unit and transmitted signals for detection by remote devices.

By use of these embodiments the number of individual units needed to handle the variety of drain designs is greatly reduced, reducing cost of the unit and simplifying inventories.

DETAILED OF THE PREFERRED EMBODIMENTS

Figure 1:
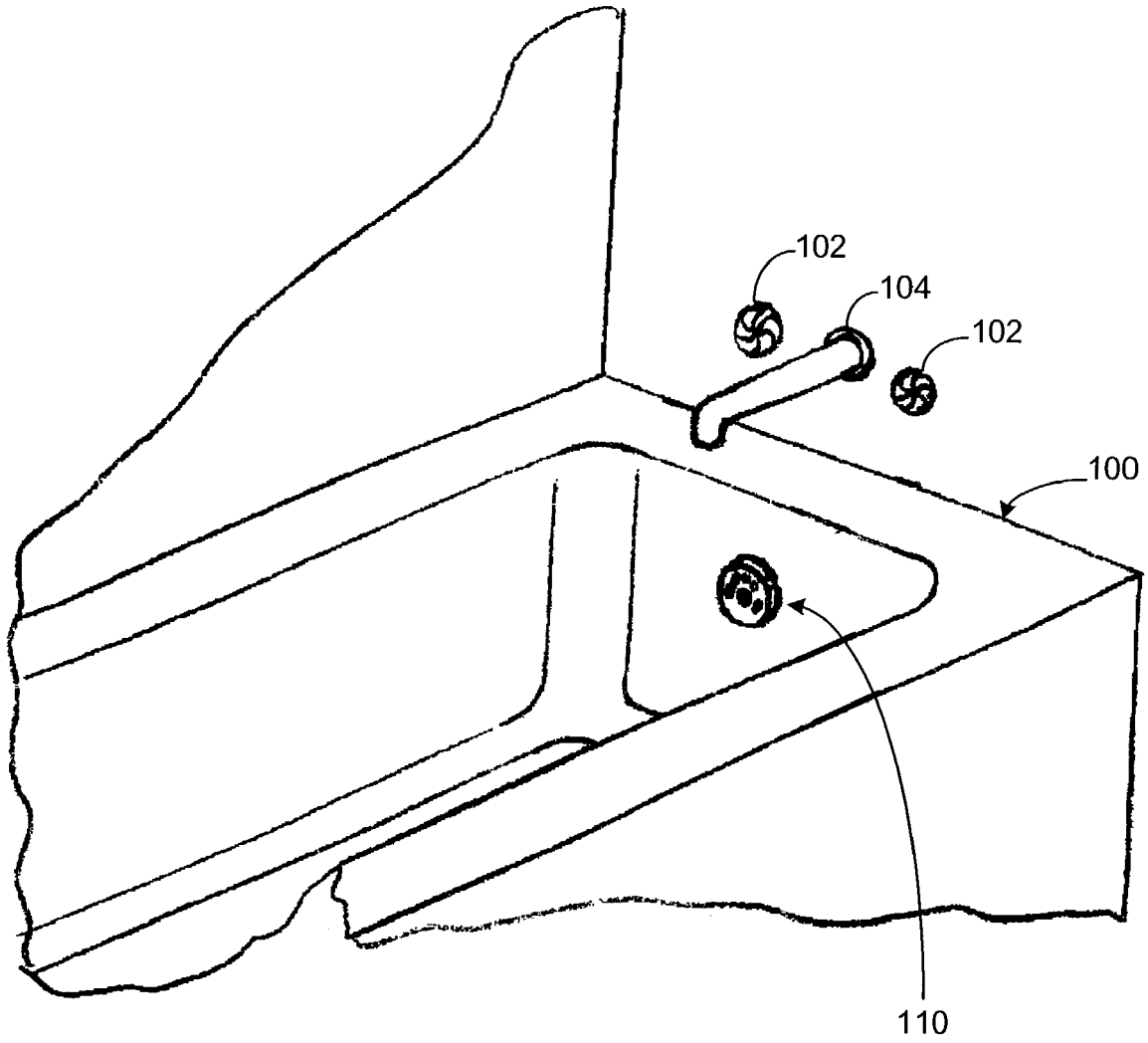
FIG. 1 is a perspective view of a portion of a bathtub and wall area with a bath overflow alarm according to the present invention.

FIG. 1 illustrates generally a bathtub 100 with associated handles 102 and spout 104. A bath overflow alarm 110 is mounted over the overflow drain (not shown).

Figure 2:
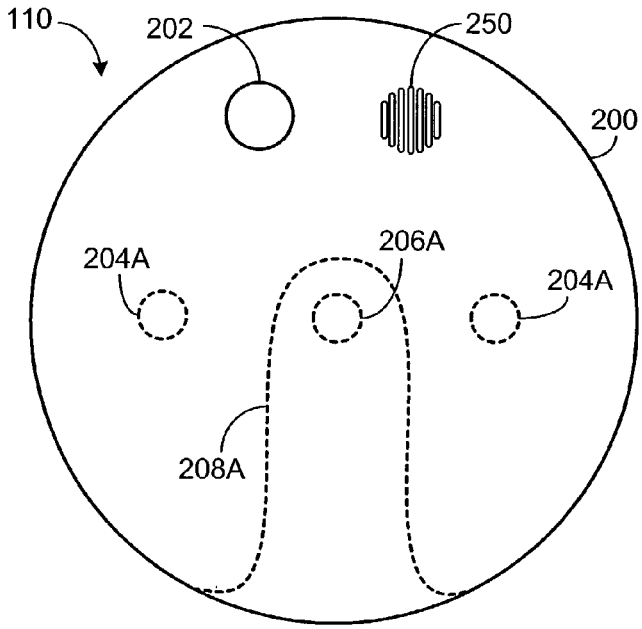
FIG. 2 is a front view of a first embodiment of a bath overflow alarm according to the present invention.

FIGS. 2–5 are drawings of various views and components of a bath overflow alarm 110 according to a first embodiment of the present invention. FIG. 2 shows a front view of the alarm 110. An outer housing 200, preferably made of a plastic or plated metal material, is shown. An alarm test/reset button 202 is present on the front face. The button 202 is used to test the alarm 110, both for local operation and remote operation, and to reset the alarm 110 if a warning has been provided. Preferably the local operation is tested by depressing the button 202 for a first period and releasing it, while remote operation is tested by depressing the button 202 for a second period, preferably longer than the first period, and releasing it. Depressing the button 202 while an alarm condition is present resets the alarm 110. A speaker area 250 is also on the face of the alarm 110. The speaker area 250 corresponds to the location of a speaker 252 and is preferably formed from a series of grooves in the housing 200. The grooves can be on the face, as shown, or on the back. Grooves are preferred over slots to preserve the water tight nature of the housing 200, but slots could be used if the opening is otherwise made watertight.

Figure 3:
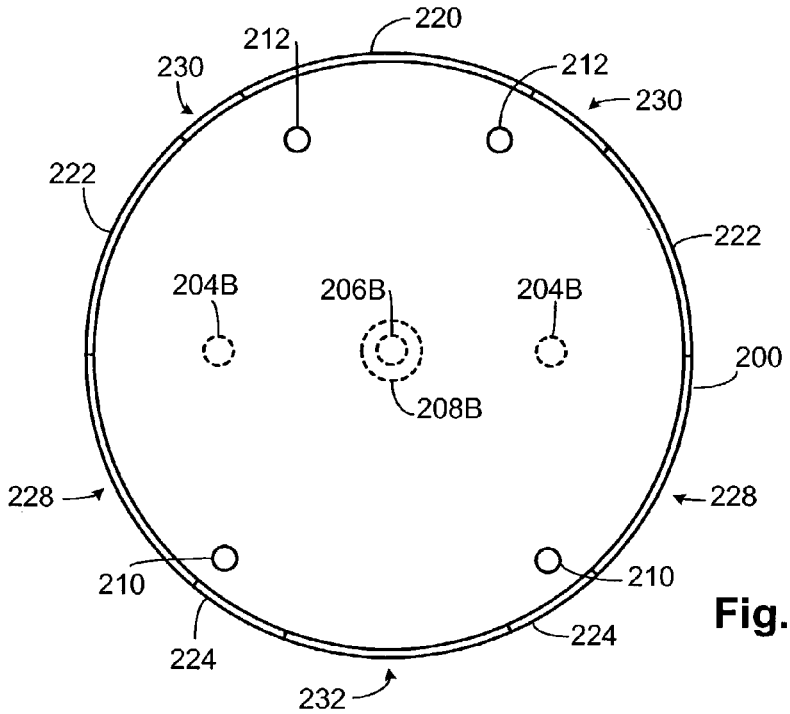
FIG. 3 is a back view of the bath overflow alarm of FIG. 2.

Shown in dashed lines in FIGS. 2 and 3 are removable areas 204A, 204B, 206A, 206B, 208A and 208B. Areas 204A and 204B correspond to the first common American overflow design utilizing two screws. Preferably the areas 204A and 204B have a thin border so that they are easily removed from the housing 200 if they are to be used but remain hidden if not used. Area 204A would have a different size, and potentially different shape, then area 204B to allow for the screw head. Areas 206A and 206B provide a center hole to be used with the second common American overflow design using a single centered screw. Again, areas 206A and 206B are preferably molded in the housing 200 with a thin border to allow easy removal and area 206A is sized for a screw head, while area 206B is sized for the threaded portion of the screw. Areas 208A and 208B are the third possible removable areas to correspond with the third common alternative using a lever arm and would be used in combination with areas 204A and 204B. Area 208A provides for an opening to allow substantially flush installation of the lever arm, while area 208B provides an opening for the threaded portion of the lever arm. By allowing the lever arm to be flush with the housing 200, the probability that the lever arm can be reused is increased because any added thickness of the alarm 110 is greatly reduced. Thus the appropriate areas 204A and 204B, 206A and 206B and/or 208A and 208B are removed depending upon the particular arrangement of the bathtub to which the alarm 110 is being installed. The housing 200 is designed to remain watertight in all cases.

The areas 204B, 206B, and 208B are shown in FIG. 3, the rear view of the alarm 110. Also shown in FIG. 3 are the water level sensors 210 and 212. Preferably the sensors 210 and 212 are capacitive sensors but other well-known sensors, such as resistive sensors or displacement mechanisms could be utilized. Two sets of sensors 210 and 212 are used in the preferred embodiment to allow initial and critical warnings.

Figure 4:
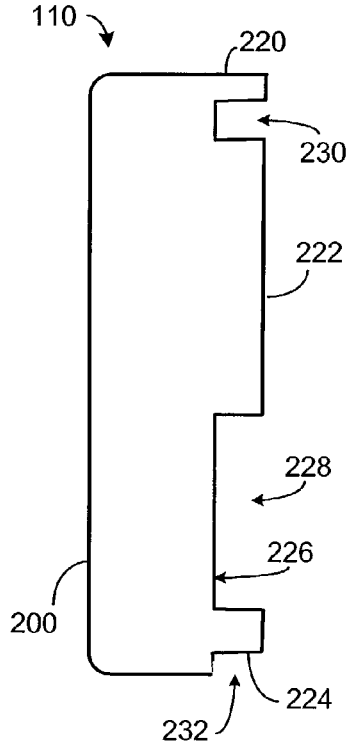
FIG. 4 is a side view of the bath overflow alarm of FIG. 2.

The overflow drain function remains as shown by FIG. 4. Portions 220, 222 and 224 of the housing 200 extend beyond the base 226 to provide drain slots 228, 230 and 232. Preferably the drain slots 228, 230 and 232 provide increased drain area to allow additional flow into the bathtub overflow drain to not exacerbate the potential overflow problem.

Figure 5:
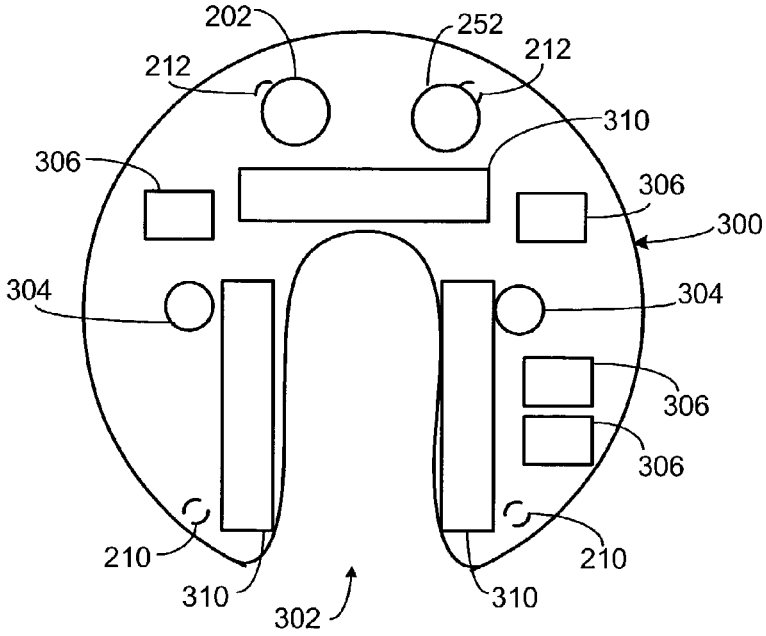
FIG. 5 is a front view of an embodiment of a circuit board for use with the bath overflow alarm of FIG. 2.
Figure 6:
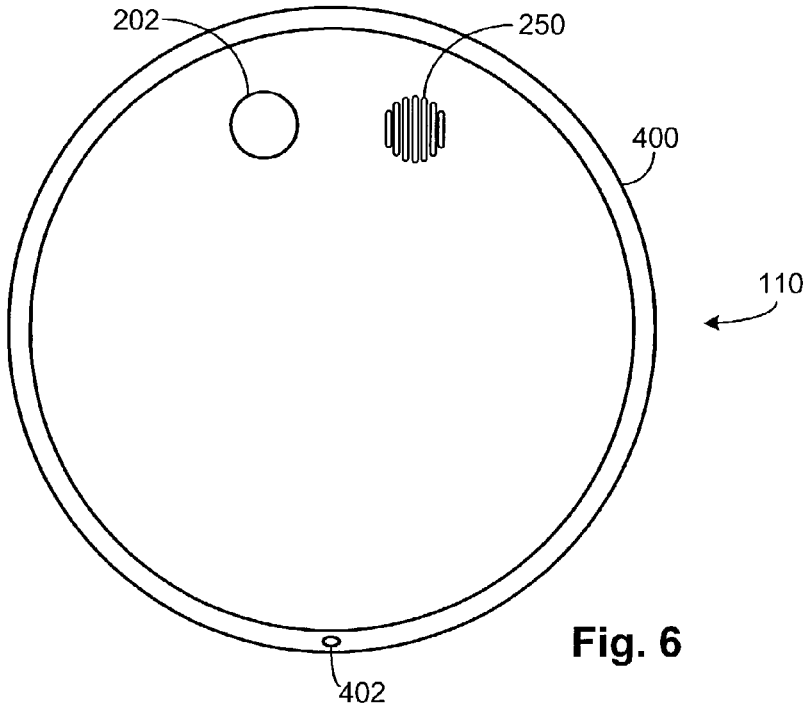
FIG. 6 is a front view of a second embodiment of a bath overflow alarm according to the present invention.
Figure 7:
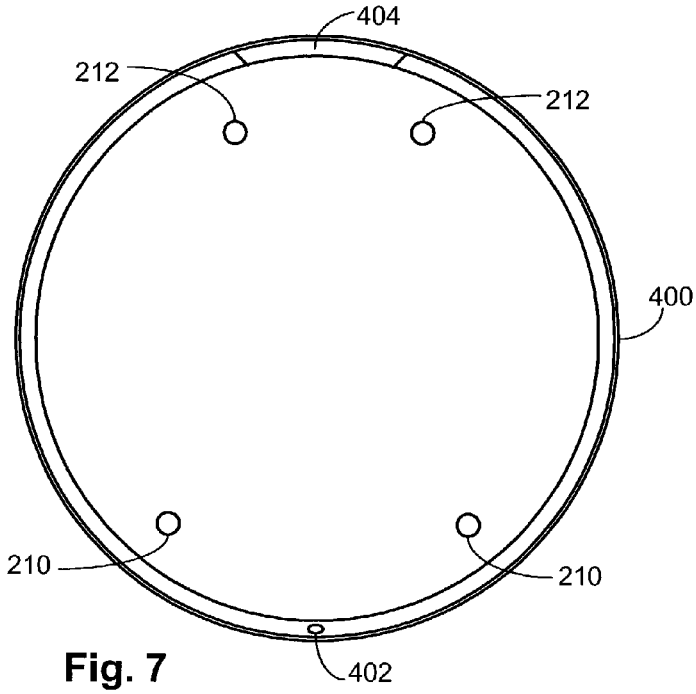
FIG. 7 is a back view of the bath overflow alarm housing of FIG. 6
Figure 8:
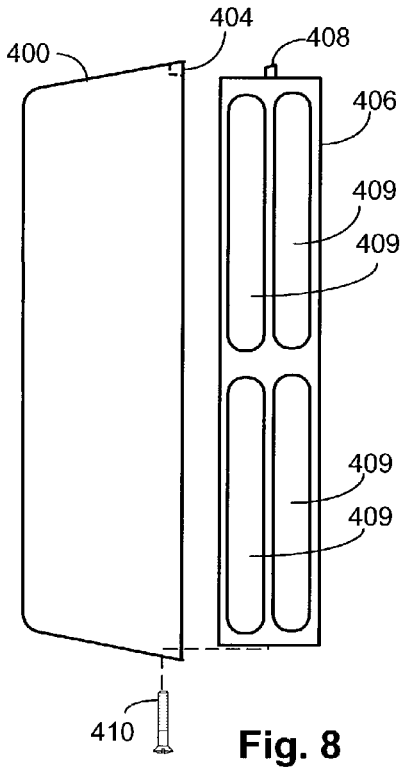
FIG. 8 is an exploded side view of the bath overflow alarm of FIG. 6.
Figure 9:
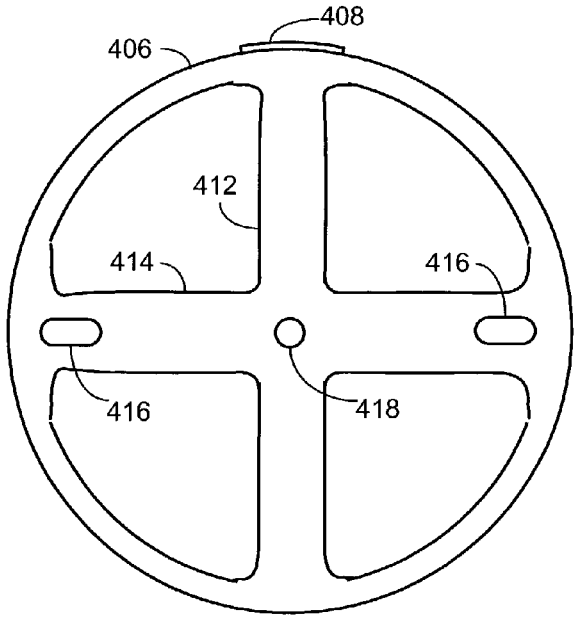
FIG. 9 is a front view of the adapter ring of FIG. 8.

An exemplary circuit board 300 for use inside the housing 200 is shown in FIG. 5. The test/reset button 202 and the sensors 210 and 212 are shown. As shown the circuit board 300 includes cutout areas 302 and 304 corresponding to areas 208 and 204, respectively. Various electronic devices or chips 306 are located on the circuit board 300. These chips 306 connect to the sensors 210 and 212 to detect the water level. When water is detected, an audible alarm is sounded using speaker or transducer 252. A first sound can be used for the initial level and a second sound for the critical level. The chips 306 can also include a radio transmitter to provide a low power signal to a pager or remote warning device. The remote warning device may be audible, vibratory, visible, digital or a combination, with local reset on the remote device. If the alarm 110 is used in a commercial setting, such as a hotel, an identifier, preferably an encoded digital value, can be included in the radio transmission, with the remote device decoding the identifier to indicate which unit has the potential overflow condition. Batteries 310 provide the electrical power for the alarm 110. Various types of batteries can be used based on the size of housing 110 and the power requirements of the chips 306.

A second multi-use embodiment is shown in FIGS. 6–9. In this second embodiment a housing 400 is utilized with an adapter ring 406. The housing 400 includes then test/reset button 202, speaker area 250, and sensors 210 and 212 as in the first embodiment, with a similar circuit board contained in a watertight environment inside the housing 400. The housing 400 also contains a screw hole 402 and a retaining tang 404 used in cooperation with the adapter ring 406. The adapter ring 406 includes a protruding tab 408 to cooperate with the retaining tang 404. The adapter ring 406 also includes a threaded hole (not shown), slot or tang to mate with a screw 410. The adapter ring 406 can mate with the housing 400 in numerous other configurations if desired. The adapter ring 406 can be formed of plastic or metal as desired.

The adapter ring 406 includes a vertical web element 412 and a horizontal web element 414. The horizontal web element 414 includes holes 416 and 418 to allow use with center screw or two screw overflow drains. The holes 416 are preferably slotted. The adapter ring 406 includes drain slots 409 to allow water to enter the overflow drain.

The second embodiment of FIGS. 6–9 is used by first installing the adapter ring 406 to the bathtub 100. Then the housing 400 is placed over the adapter ring 406 so that the tab 408 is captured by the tang 404. Screw 410 is then inserted through hole 402 and threaded into the hole in the adapter ring 406.

Figure 10:
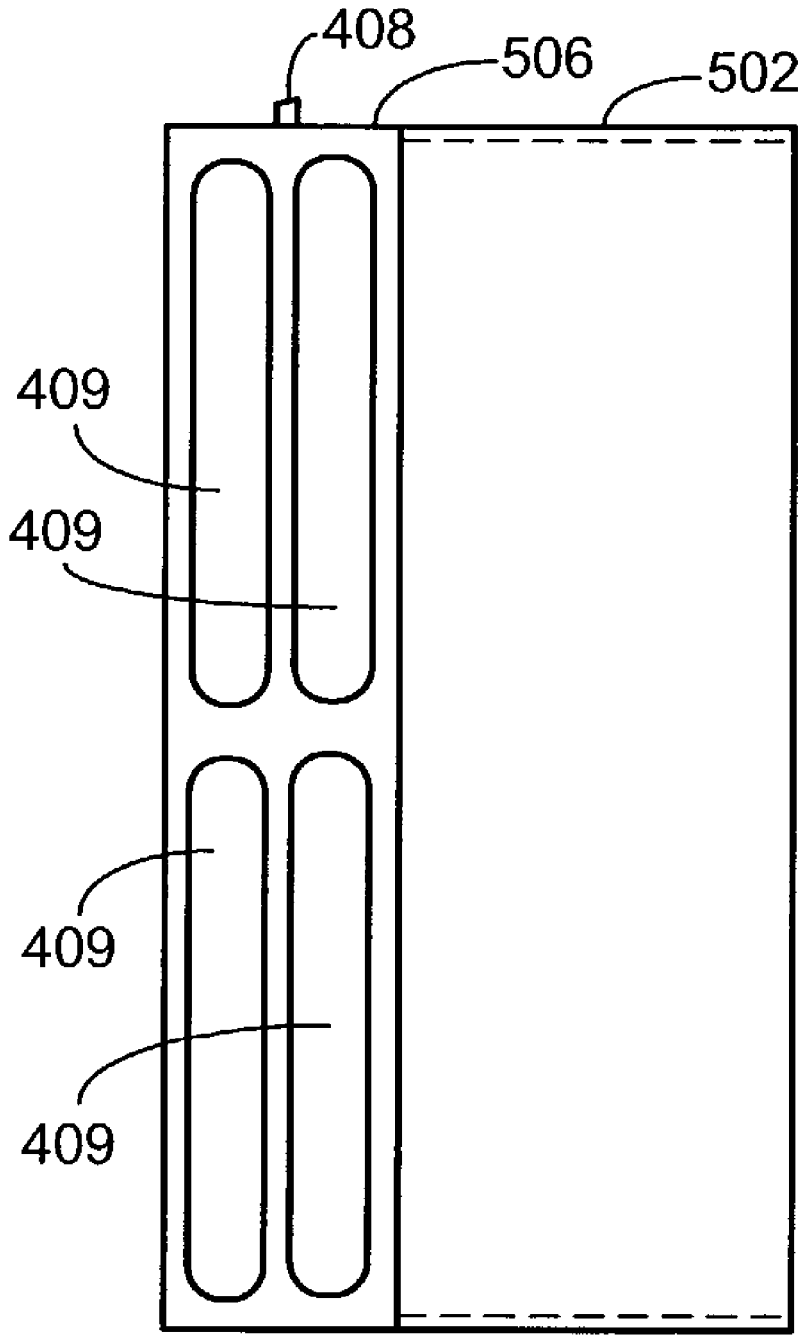
FIG. 10 is a side view of an alternate embodiment of an adapter ring for use with the embodiment of FIG. 6.

An alternative adapter ring 506 is shown in FIG. 10. In this embodiment the adapter ring 506 does not contain any web elements but is extended, with the extended area 502 being threaded to mate with European and newer American threaded overflow drains. The threaded area is shown on the inside of the extended area 502 in FIG. 10 for use with European designs but could be on the outside of the extended area 502 for use with newer American designs.

Alternatively, both inside and outside could be threaded to cover both cases, particularly if the adapter ring 506 is plastic. Thus, only the adapter ring 506 need changed, with the housing 400 being reusable.

As shown, an alarm 110 replaces the existing overflow cover plate for various types of overflow cover plates without changing the electronics within or requiring different designs for each cover plate variation. The embodiments allow increased water flow areas on the sides and back of the alarm to help drain the water faster than the existing cover plate.

To use this device for an American bathtub, remove the existing overflow cover plate screws. After installing the batteries into the overflow alarm 110, which automatically turns the alarm on, the alarm 110 is mounted using the existing screw locations. In the first embodiment the proper areas are removed from the housing 200 and the housing 200 is screwed to the bathtub 100. In the second embodiment the adapter ring 406 is mounted to the bathtub 100 and the housing 400 is then mounted to the adapter ring 406.

As you add water to the bathtub 100, the first sensors 210 detect the presence of water and trigger the alarm circuit, which sets off the local audible alarm and at the same time preferably sends a signal to any remote device. Should the water reach to top sensors 212, another audible alarm is triggered locally and remotely with a different tone and different frequency.

If desired, a visual display may be added to the face of the housing to indicate the battery status. Additionally, while the alarms are shown in a round or cylindrical shape, other shapes such as square, oval and so on can be readily used. Additionally, any color or finish can be used. Also any of the embodiments can be made of plastic, metal or other substance.

As can be seen, embodiments according to the present invention address the shortcomings of the prior art devices.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

What is claimed is:

1. A bath overflow alarm for mounting to the overflow drain of a bathtub, the overflow drain having one of at least two different configurations to mount an overflow plate, the alarm comprising:

a single mounting unit having at least two different mounting configurations corresponding to the at least two different overflow plate mounting configurations of the overflow drain and having an overflow passage; and an alarm unit including;

a sensor for detecting the presence of water; and an alarm output coupled to said sensor and activated when the presence of water is detected.

2. The alarm of claim 1, wherein said mounting unit is a housing and said alarm unit is contained inside said housing.

3. The alarm of claim 2, wherein said housing is formed of a plastic material and includes removable portions for each of the mounting configurations.

4. The alarm of claim 3, wherein the mounting configurations include two screw and center screw configurations.

5. The alarm of claim 4, wherein the mounting configurations further include a lever configuration.

6. The alarm of claim 2, wherein the mounting configurations include two screw and center screw configurations.

7. The alarm of claim 2, wherein the mounting configurations include center screw and lever configurations.

8. The alarm of claim 7, wherein the mounting configurations further include a two screw configuration.

9. The alarm of claim 2, wherein said housing includes extended portions with openings between said extended portions to form said overflow passage.

10. The alarm of claim 2, wherein said alarm unit further includes a button and said housing includes an opening to cooperate with said button.

11. The alarm of claim 10, wherein said button operates with said alarm unit to activate said alarm output and to deactivate said alarm output.

12. The alarm of claim 1, further comprising a housing adapted to removably mate with said mounting unit and to contain said alarm unit.

13. The alarm of claim 12, wherein the mounting configurations include two screw and center screw configurations.

14. The alarm of claim 13, wherein said mounting unit is generally formed in a ring shape and includes a horizontal web, said horizontal web adapted to include holes to cooperate with the two screw and center screw mounting configurations.

15. The alarm of claim 14, wherein said mourning unit includes openings in said ring shape to form said overflow passage.

16. The alarm of claim 12, wherein said alarm unit further includes a button and said housing includes an opening to cooperate with said button.

17. The alarm of claim 16, wherein said button operates with said alarm unit to activate said alarm output and to deactivate said alarm output.

18. The alarm of claim 1, wherein said alarm output is an audible output.

19. The alarm of claim 1, wherein said alarm output is a radio transmission.

20. The alarm of claim 19, wherein said alarm output is additionally an audible output.

* * * * *